US007490395B2

(12) United States Patent
Coffield et al.

(10) Patent No.: US 7,490,395 B2
(45) Date of Patent: Feb. 17, 2009

(54) METHOD AND APPARATUS FOR ATTACHING ACCESSORIES TO LOAD-BEARING FABRIC

(75) Inventors: Timothy P. Coffield, Grand Rapids, MI (US); Tanja Krstov, Kentwood, MI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/331,809

(22) Filed: Jan. 12, 2006

(65) Prior Publication Data

US 2006/0145527 A1 Jul. 6, 2006

Related U.S. Application Data

(62) Division of application No. 10/307,632, filed on Dec. 2, 2002, now Pat. No. 7,021,718.

(51) Int. Cl.

| | |
|---|---|
| ***B23P 11/00*** | (2006.01) |
| ***B68G 7/00*** | (2006.01) |
| *A47C 7/02* | (2006.01) |
| *F16B 15/00* | (2006.01) |

(52) U.S. Cl. ..... 29/432; 29/469; 29/525.01; 29/525.02; 29/525.03; 29/525.04; 29/91.1; 411/457; 411/469; 411/450

(58) Field of Classification Search ..... 29/432, 29/469, 525, 525.01, 525.02, 525.03, 525.04, 29/91, 91.01; 24/614, 615, 618, 697.1; 297/218.1, 297/218.5, 452.6, 452.59, 218.3; 383/63; 211/87.01, 59.1, 85.2; 411/450, 457, 469
See application file for complete search history.

(56) References Cited

U.S. PATENT DOCUMENTS 3,765,039 A * 10/1973 Ewoldt ..... 5/402
4,287,657 A * 9/1981 Andre et al. ..... 29/450
4,610,250 A * 9/1986 Green ..... 606/220
4,625,370 A * 12/1986 Fukuroi et al. ..... 24/601.7
4,789,201 A * 12/1988 Selbert ..... 297/218.1
5,240,120 A * 8/1993 McDonough ..... 211/85.2
5,275,578 A * 1/1994 Adams ..... 482/27
5,295,587 A * 3/1994 Downes et al. ..... 211/85.2
5,467,509 A * 11/1995 Fukushima ..... 24/689
5,482,352 A * 1/1996 Leal et al. ..... 297/217.4
5,826,312 A * 10/1998 Schroder et al. ..... 24/601.2

(Continued)

FOREIGN PATENT DOCUMENTS

GB 2163645 A * 3/1986

*Primary Examiner*—Essama Omgba
(74) *Attorney, Agent, or Firm*—Warner Norcross & Judd LLP

(57) ABSTRACT

An apparatus for attaching an item to load-bearing fabric including male and female strips that snap together on opposite sides of the fabric. The male strip is attached to the item to be secured to the fabric, and includes male prongs that are pushed through the weave of the load-bearing fabric. The female strip preferably defines a series of receptacles that snap onto the male strip. The male and female strips are elongated strips formed from a molded thermoplastic or other formable material. In a preferred embodiment, the male prongs include barbs and the receptacles include angled fingers that act as a snap, such that the barbs of the male prongs can easily be pressed through the fingers, but are retained once in place.

5 Claims, 5 Drawing Sheets

U.S. PATENT DOCUMENTS 5,985,961 A * 11/1999 Dailey et al. ..... 524/100
6,029,829 A * 2/2000 Ovadia ..... 211/85.2
6,076,888 A * 6/2000 Turletti ..... 297/218.3
6,283,552 B1 * 9/2001 Halse et al. ..... 297/440.1
6,406,093 B1 * 6/2002 Miotto et al. ..... 297/218.5
6,481,064 B2 * 11/2002 Kawahara ..... 24/108
6,662,373 B2 * 12/2003 Frank ..... 2/94
6,942,300 B2 * 9/2005 Numa et al. ..... 297/452.56
7,021,718 B2 * 4/2006 Coffield et al. ..... 297/452.59
7,194,787 B2 * 3/2007 Murai et al. ..... 24/615
2002/0101109 A1 * 8/2002 Stiller et al. ..... 297/452.6
2003/0001421 A1 * 1/2003 Schmidt ..... 297/452.6
2005/0194829 A1 * 9/2005 Aerts ..... 297/452.59

* cited by examiner

METHOD AND APPARATUS FOR ATTACHING ACCESSORIES TO LOAD-BEARING FABRIC

This application is a division of application Ser. No. 10/307,632, filed Dec. 2, 2002 (Now U.S. Pat. No. 7,021,718).

BACKGROUND OF THE INVENTION

The present invention relates generally to an attachment device for attaching accessories to fabric, and more particularly to a method and apparatus for attaching accessories to load-bearing fabric.

Load-bearing fabrics are becoming an increasingly popular load-bearing component for a wide variety of applications, such as office seating, automotive seating, keyboard trays and other similar components. Typically, load-bearing fabrics are supported over an opening by a peripheral frame. Load-bearing fabric is generally woven or otherwise fabricated from elastomeric monofilaments (or multifilaments). The elastomeric material is often combined with a support yarn. For example, in one conventional form, a plurality of elastomeric monofilaments are interwoven with a plurality of support yarns. The elastomeric material gives the load-bearing fabric a degree of elasticity. The elasticity can be controlled by varying, among other things, the characteristics of the elastomeric materials and the support yarn. This elasticity makes load-bearing fabrics particularly well suited for use in a wide variety of load supporting applications.

In many application, it is desirable to attach accessories to the load-bearing fabric. While the peripheral frame provides a structure to which accessories can sometimes be attached near the outside edge of the fabric, components attached to the inner region of the fabric, away from the periphery, must generally be attached to the fabric itself. In seating applications, seat bolsters and lumbar supports are two of the most common accessories that require attachment to fabric. Bolsters are commonly used in seating applications to provide support for the hips and thighs of the occupant of the seat. Although available in a variety of configurations, a seat bolster often includes a foam support that is disposed along opposite sides of a seat bottom. To provide proper support to a person sitting in the seat, a conventional bolster typically extends a substantial distance inwardly from the outer edge of the seat. As a result, while the outer edge of the bolster may be attached to the peripheral frame of the seat, the inner edge of the bolster is preferably somehow attached directly to the load-bearing fabric.

One conventional method of attaching an accessory to load-bearing fabric is to simply sew the accessory to the fabric at the desired location. If the accessory is made of fabric, or some other material capable of being sewn, then the manufacturer can position the accessory on the load-bearing fabric and stitch the two fabrics together. This method can be effective at firmly attaching the accessory to the fabric, but a significant drawback is the excessive assembly time. Stitching each individual accessory to the load-bearing fabric consumes a substantial amount of time, especially in the context of an assembly line. Further, in some applications, it is difficult to form the stitching where it will not be seen in the finished product. Additionally, the stitching process may damage some of the strands of the load-bearing fabric, possibly reducing the life of the product. Alternatively, adhesives can be used to adhere the accessory to the fabric by coating the contact area of the accessory and fabric with the adhesive and pressing the two together. Due to the mesh characteristic of most load-bearing fabrics, adhesive can be difficult to apply. It can also be difficult to achieve the strength and durability of bond that is necessary to meet the needs of many accessories.

An alternative method for securing a bolster to a load-bearing fabric seat is disclosed in U.S. Pat. No. 6,283,552 to Halse et al. ("Halse"). Halse is directed a fastener that is intended to be secured to a bolster, for example, by stitching. The fastener includes a number of male prongs extending from an elongated strip. Each male prong has a pointed stem and a pair of barbs that project from opposite sides of the stem. The fastener is attached by forcing the male prongs through the fabric. Once the barbs pass through the fabric they catch on the strands of the load-bearing fabric to resist removal of the fastener. This secures the fastener, and consequently the bolster, to the fabric.

The Halse fastener provides certain advantages over other conventional attachment methods, such as the sewing and adhesive methods discussed above. These benefits arise primarily from the time it can save in attaching the accessory to the load-bearing fabric. Instead of sewing or setting the adhesive of each attached accessory, the fastener and bolster assembly can quickly be pushed through the fabric and secured. The Halse fastener, however, still faces some drawbacks. The barbs extending from the male prongs rub directly on the load-bearing fabric, such that the barbs wear on the fabric with the possibility of damaging the fabric over time. Further, it can be difficult to control the strength of the attachment with this type of fastener, which can be very important, especially in the highly standardized automotive industry. Additionally, the barb size must be carefully matched to the characteristics of the load-bearing fabric to provide optimal results.

SUMMARY OF THE INVENTION

The aforementioned problems are overcome by the present invention wherein a fastener includes male and female strips that snap together on opposite sides of the fabric. The male strip includes male prongs that are passed through the weave of the load-bearing fabric and interlock with the female strip. The female strip preferably defines a series of receptacles that permit the female strip to be snap fitted onto the male strip. In use, either the male strip or the female strip is attached to the item, or accessory, to be secured to the fabric, for example, by adhesive, stitching, direct molding, or otherwise. The other strip is then positioned on the opposite side of the fabric. The two strips are then brought together sandwiching the fabric with the male prongs passing through the fabric and interlocking with the female strip.

In a preferred embodiment, the male strip is an elongated strip formed from a molded thermoplastic or other formable material. The male strip includes a base section and a plurality of prongs. The base section preferably extends the length of the item to be attached, such that the base can be stitched or otherwise attached continuously down the length of the item. The base section also preferably includes a number of slits that are cut into its width. The slits add flexibility to the male strip. The male prongs preferably extend perpendicular from the base section of the male strip. Each prong includes a stem with a barb at the end, the barb tapering to a point such that the point can easily be pushed through the load-bearing fabric and the female strip, but once through, the barb holds the prong inside the female strip.

Also in the preferred embodiment, the female strip is an elongated strip, including a plurality of receptacles that have the same spacing as the prongs of the male strip. In a preferred embodiment, the receptacles include angled fingers that act as a snap, such that the barb of the male prong can easily be pressed through the fingers, but is retained once in place. The angle and other characteristics of the fingers can be adjusted to meet the retention needs of any particular item to be attached.

The present invention also provides a method for attaching an item to load-bearing fabric. The method generally includes the steps of (a) attaching the accessory to the male strip or the female strip by a conventional attachment method, such as stitching, (b) forcing the prongs of the male strip through the filaments in the weave of the load-bearing fabric, and (c) snapping the female strip over the male prongs.

The present invention is capable of attaching a wide variety of accessories to load-bearing fabric. The length of the strip can be adapted to fit the length of any item to be attached, and the retention strengths can be adjusted to accommodate a wide range of needs. The combination of male and female strips allows the force of the attachment to be distributed over a larger portion of the fabric, thereby strengthening the attachment and reducing the likelihood of damage to the fabric. Further, the fabric is sandwiched between planar surfaces and does not provide a catch for the prongs of the male strip. This further minimizes the chance that the fastener will wear on or otherwise damage the fabric. The present invention also aids in the production process because it permits the accessory to be quickly snapped into place on the load-bearing fabric.

These and other objects, advantages, and features of the invention will be readily understood and appreciated by reference to the detailed description of the preferred embodiment and the drawings.

DETAILED DESCRIPTION OF THE PREFERRED EMBODIMENT

I. Overview

Figure 1:
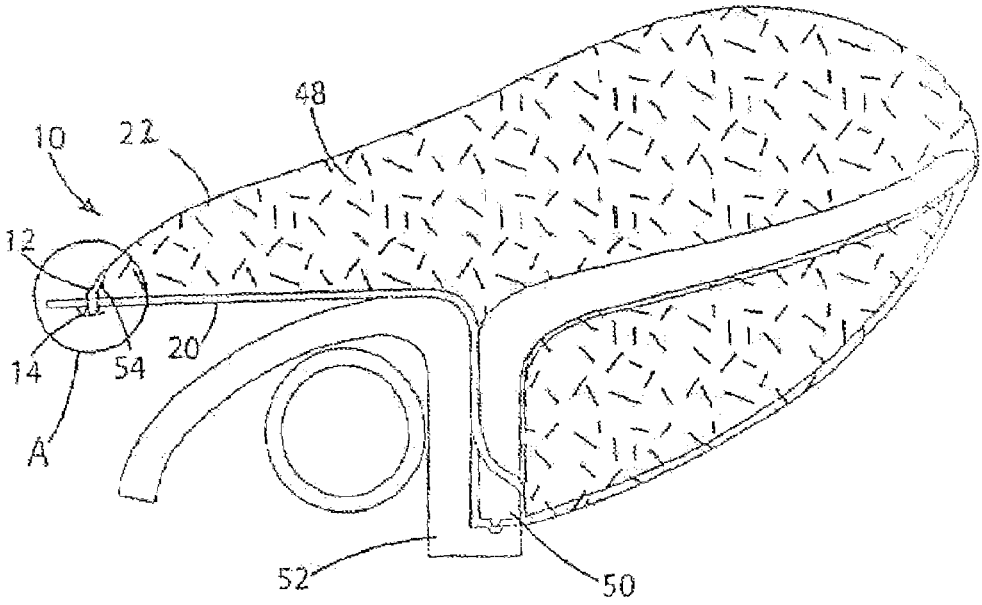
FIG. 1 is a cross sectional view of a seat bolster assembly incorporating the attachment device of the present invention.

A seat bolster assembly incorporating an attachment device in accordance with a preferred embodiment of the present invention is shown in FIG. 1 and generally designated 10. For purposes of disclosure, the present invention is described in connection with the attachment of a seat bolster 22 to a load-bearing fabric seat 20. The present invention is, however, well suited for use in attaching other components to load-bearing fabric. In the described embodiment, the attachment device 10 generally includes a male strip 12 and a female strip 14. The male strip 12 includes a base portion 16 and a plurality of prongs 18 extending from the base portion 16. The female strip includes a plurality of receptacles 24 for receiving the prongs 18 and retaining them. In operation, the bolster 22 is attached to the base portion 16 of the male strip 12, and the male prongs 18 are then pushed through the filaments 26 (or stands) of fabric 20 and into the receptacles 24 of the female strip 14. The prongs 18 interlock with the receptacles 24, securely entrapping the fabric 20 between the male strip 12 and the female strip 14. Alternatively, the bolster 22 can be attached to the female strip. With this alternative, the female strip may be provided with an additional attachment portion, such as the base portion 16 of the male strip 12.

II. Structure

The present invention is shown in FIG. 1 and generally designated 10 (encircled by circle A). As noted above, the present invention is described in connection with a bolster accessory 22, shown in FIG. 1, for purposes of disclosure and not as a limitation on the invention. In general, a seat bolster is a cushioned support structure extending along opposite sides of the seat bottom. The bolster provides support for the hips and thighs of a person sitting in the seat. When used in connection with a load-bearing fabric, bolsters generally include a foam insert 48 that is wrapped in fabric 23. In one embodiment, the outer edge 50 of the fabric 20 is attached to a peripheral frame 54 that supports the seat and load-bearing fabric 20. The inner edge of the fabric 23 is attached directly to the load-bearing fabric 20 inboard of the peripheral frame 54 by the present invention 10.

Figure 2:
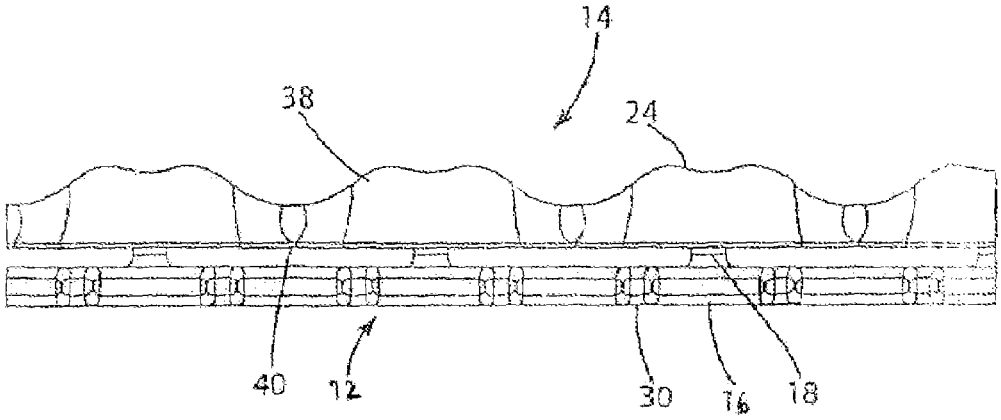
FIG. 2 is a side view of the male and female strips in the attached position with no load-bearing fabric present.
Figure 3:
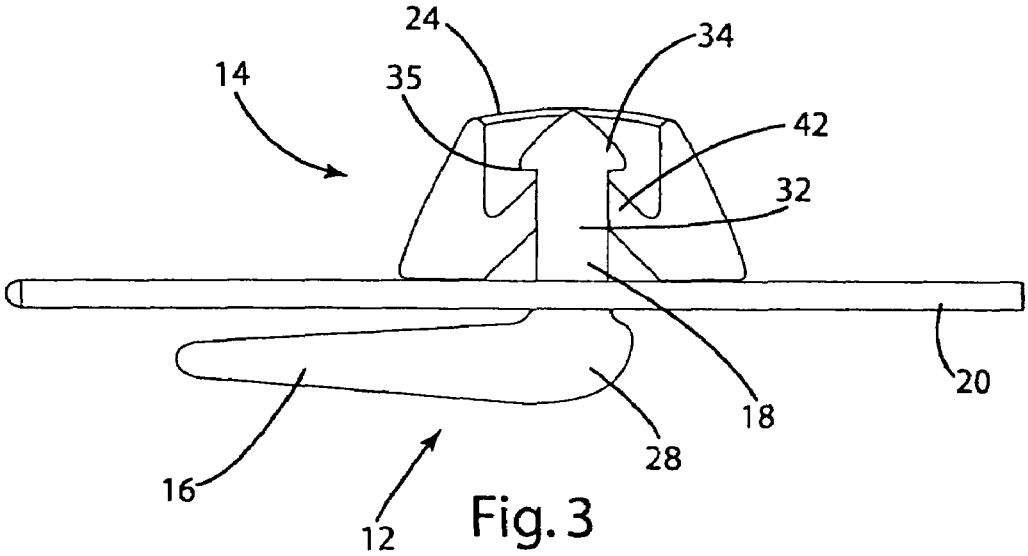
FIG. 3 is an enlarged cross sectional view showing the assembly attached to a portion of load-bearing fabric.
Figure 4:
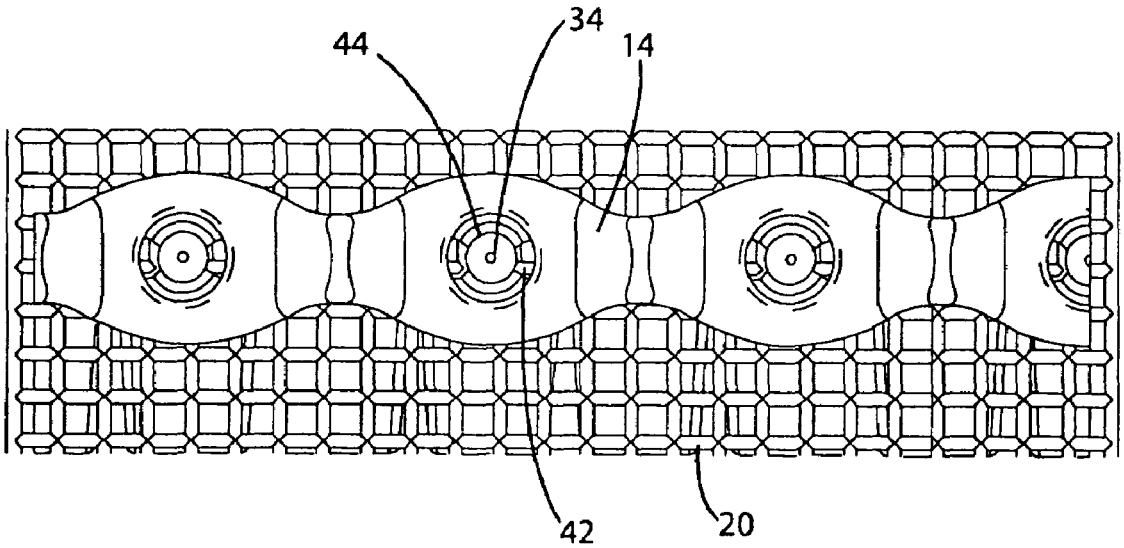
FIG. 4 is a bottom plan view of the assembly attached to a portion of load-bearing fabric.
Figure 5:
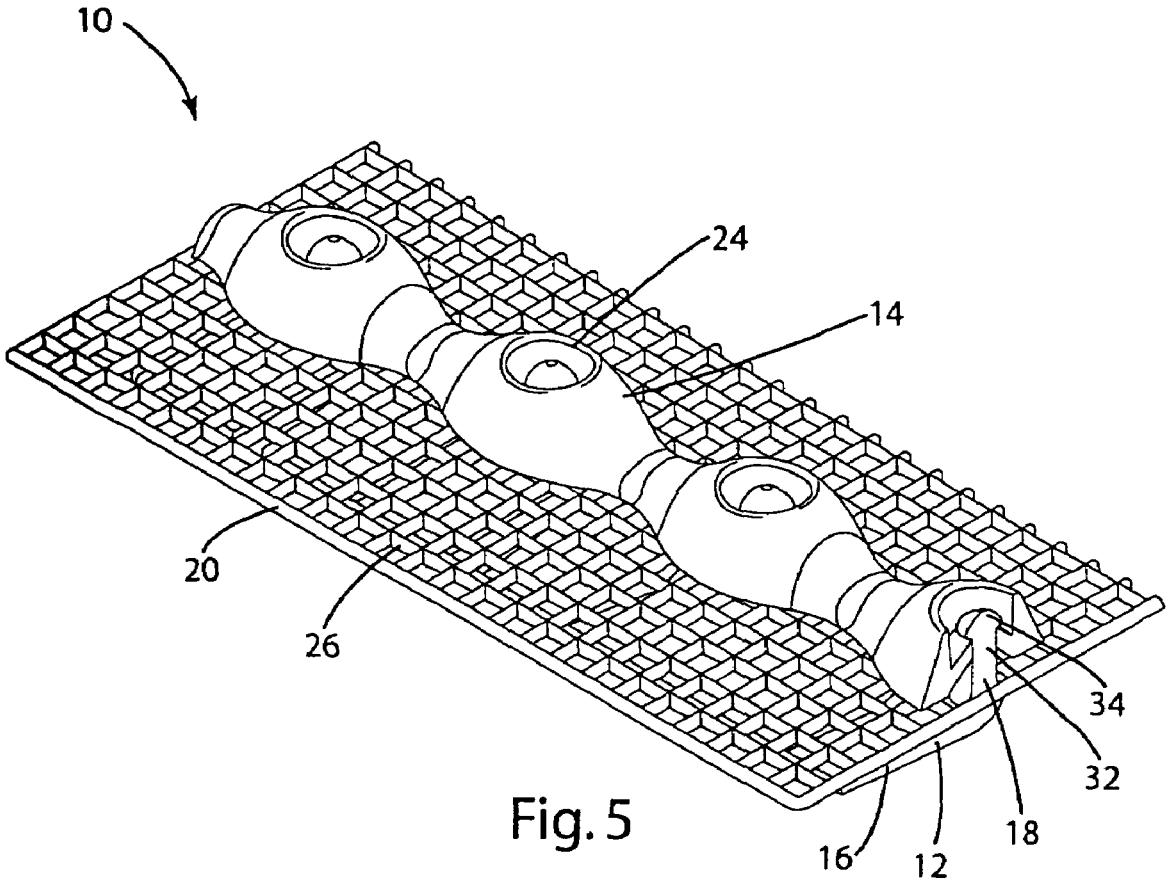
FIG. 5 is a bottom perspective view of the assembly attached to a portion of load-bearing fabric with one end of the assembly sectioned to show the internal interaction between the male and female strips.
Figure 7:
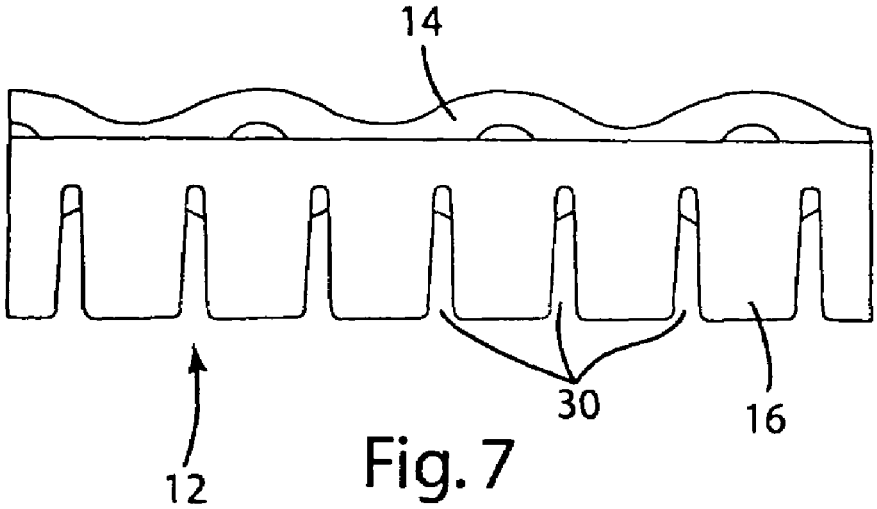
FIG. 7 is a top plan view of the assembled male and female strips with no fabric present.

As noted above and as shown in FIG. 2, the present invention includes a male strip 12. The male strip 12 generally includes a base portion 16 and a plurality of prongs 18. The base portion 16 is an elongated section of this material, usually having a length approximately equal to the length of the accessory 22 that will be attached to the load-bearing fabric 20. FIG. 3 shows the cross section 28 of the base portion 16 in a wing shape, which is the preferred embodiment of the invention. The cross sectional shape may, however, be altered to accommodate the specific characteristics of any desired accessory 22 or load-bearing fabric 20. Referring now to FIG. 7, the male strip 12 may be intermittently broken up by slits 30 in the base portion 16 to provide the male strip 12 with the desired flexibility. In the illustrated embodiment, the slits 30 are formed approximately three-quarters of the way through the width of the male strip 12, and are located at equal intervals down the length of the strip. The slits 30 may also be seen in FIG. 4, by looking through the fabric 20 at the male strip 12.

In the illustrated embodiment, the male prongs 18 are located at equal intervals along the length of the base portion 16. The interval is preferably selected such that the prongs align with the spaces between the intersecting strands of the load-bearing fabric 20. This is not necessary, however, because the pointed tip of the prongs 18 will have the ability to move the strands somewhat during assembly. The prongs 18 and base 16 are generally molded as a homogeneous part, but the prongs could be made of a different material than the base 16 and simply attached to the base 16 by a conventional method. The prongs 18 may have any desired length, but the length is preferably substantially greater than the thickness of the fabric 20 so that the prongs 18 can pass through the fabric and interlock with the receptacles 24. Depending on the size and shape of the accessory 22 to be attached, the prongs 18 may extend from the base 16 at any desired angle. The prongs 18 generally include a cylindrical stem 32, and a barb 34 at the end of the stem 32. The barb 34 juts out from the stem 32 near the end of the stem 32, forming a ridge 35. The barb 34 then tapers from the ridge 35 to a point at the end of the prong 18. The prongs 18 may take on alternative sizes and shapes as dictated by the application.

In the preferred embodiment, the male strip 12 is manufactured from a thermoplastic material, but could be manufactured from a wide variety of alternative materials. The male strip 12 is preferable injected molded from a thermoplastic material, such as nylon, polypropylene and polyethylene, using conventional injection molding techniques and apparatus. The male strip 12 can alternatively be manufactured from other formable thermoplastic materials or even cast from a metal such as steel.

The female strip 14 may also be formed from any conventional material, and is generally made from a molded thermoplastic. In the illustrated embodiment, the length of the female strip 14 generally corresponds with the length of the male strip 12 to accommodate the length of the accessory 22. Although illustrated as continuous strips, the male strip 12 and/or the female strip 14 may be discontinuous, including a plurality of discrete, separate segments. The female strip 14 preferably defines a number of evenly spaced receptacles 24. The spacing of the receptacles 24 is preferably selected to correspond with the spacing of the prongs 18. In the illustrated embodiment, the receptacles are essentially openings extending from the outer surface of the strip 38 through the inside surface 40. The receptacles 24 are generally cylindrical, but may be of essentially any shape that accommodates the male prongs 18. The size and shape of the receptacles 24 depends primarily on the size and shape of the prongs 18. In the illustrated embodiment, the inner surface of each receptacle 24 includes opposing fingers 42. The opposing fingers 42 extend toward each other from the inner wall of the receptacle 24 and are preferably capable of a small amount of flex. Each finger 42 is angled away from the inner surface 40 of the female strip 14 towards the outer surface 38. The tip 44 of each finger 42 is generally arcuate in shape to match the cylindrical shape of the male prongs 18. Alternatively, the tip 44 may be any other shape, depending on the chosen shape of the prongs 18. The distance between the tips 44 of opposing fingers 42 in a relaxed position is generally equal to the diameter of the stem 32 of the prongs 18.

The present invention is well suited for use with a wide variety of load-bearing fabrics, including load-bearing fabrics with free or welded intersections. The present invention is described in connection with a conventional woven load-bearing fabric having a plurality of elastomeric monofilaments interwoven with a plurality of multifilament support yarns. In the illustrated seating application, the load-bearing fabric 20 forms the load bearing portion of the seat bottom and is supported over an opening by a peripheral frame 54, shown in FIG. 1. The load-bearing fabric 20 may be attached to the frame in a number of conventional methods, such as by encapsulating the material within one of the frame components and through the use of mechanical or adhesive connections.

Recognizing the increasing use of load-bearing fabrics in many different applications, the attachment device 10 is designed to accommodate a wide variety of accessories 22. FIG. 1 shows the device 10 (encircled in circle A) in use specifically for attaching a seat bolster to the load-bearing fabric of a seat. Alternatively, the accessory may be a lumbar support attached to the seat back or any of a variety of other desired accessories.

III. Assembly

A method for attaching an accessory to a load-bearing fabric will be described in connection with the attachment device 10 of the preferred embodiment. The method may vary from application to application depending on the construction of the attachment device 10, the accessory 22 and the load-bearing fabric 20.

During assembly, an accessory 22 is attached to the base portion 16 of the male strip 12, for example, by adhesive, stitching, direct molding, or any other conventional method. The attached accessory 22 and male strip 12 are then positioned over the desired attachment location of the fabric 20 with the prongs 18 pointing towards the fabric 20. The prongs 18 are then pushed through the fabric 20 until the base portion 16 of the male strip 12 contacts the fabric 20. More specifically, the prongs 18 are forced through the interstices between the interwoven monofilaments strands 26 and multifilament yarns 27 of the load-bearing fabric 20. As noted above, the accessory may alternatively be attached to the female strip, and the male strip may be used to secure the assembled accessory/female strip to the load-bearing fabric.

Figure 6:
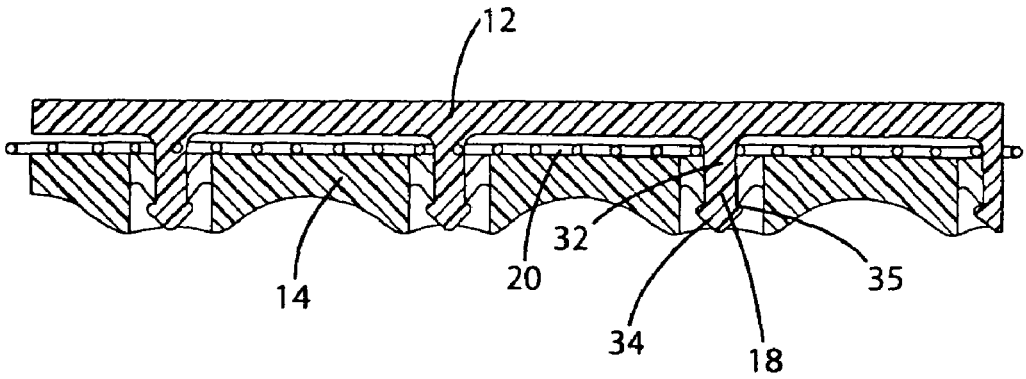
FIG. 6 is a cross sectional view of the assembly showing the interaction of the male strip, female strip and load-bearing fabric.

Once the prongs 18 have been pushed through the fabric 20, the female strip 14 is positioned over the opposite side of the fabric 20 from the male strip 12, with the inner surface 40 facing the fabric 20 such that each receptacle 24 is aligned with a corresponding prong 18. The female strip 14 is then pressed over prongs 18 so that the barb 34 of each prong 18 pushes through the opposing fingers 42. This flexes the fingers 42 causing them to open and permit passage of the prong 18. The process continues until the barb 34 emerges from the fingers 42 permitting the fingers 42 (by virtue of their resiliency) to snap back into position with the ridge 35 sitting on the finger tips 44. At this point as shown in FIG. 6, the prongs 18 are retained in the receptacles 24, and the accessory 22 is securely fastened to the fabric 20. It should be noted that the size and shape of the barbs 34, ridges 35, fingers 42 and finger tips 44 can be varied to control the amount of force required to interlock the two strips, as well as to later separate the two strips if necessary.

A wide variety of alternative assembly methods can be used to attached the accessory to the load-bearing fabric. For example, the female strip 14 may be first mounted in a fixture (not shown) and then the load-bearing fabric 20 and male strip 12 may be assembled on the female strip 14 while it is retained in the fixture.

V. Alternative Embodiments

Figure 8:
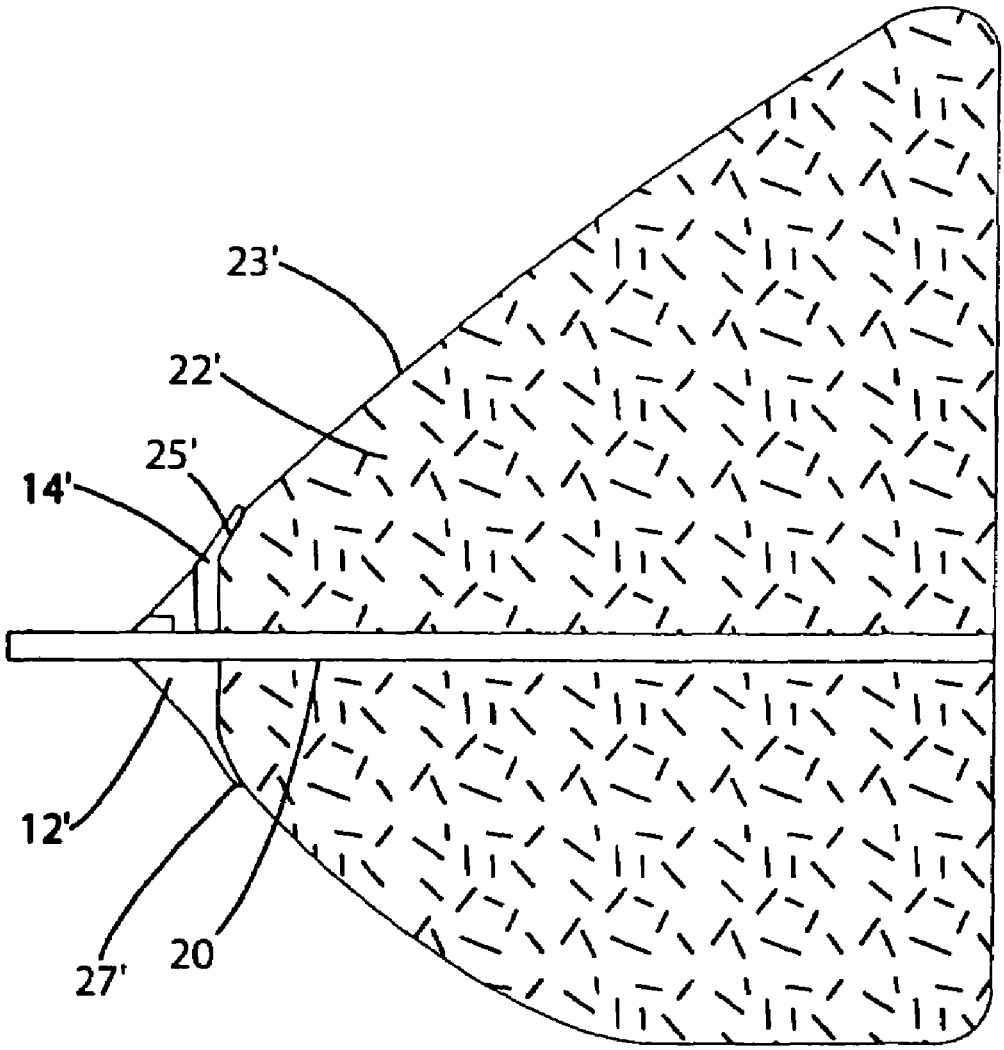
FIG. 8 is a cross sectional view of an alternative embodiment of the present invention incorporated into an alternative seat bolster construction.

In a first alternative embodiment, the accessory 22' is secured to both the male 12' and female 14' strips. For example, as illustrated in FIG. 8, this alternative embodiment can be used to secure a bolster having fabric 23' that wraps around the peripheral edge of the load-bearing fabric. A first end 25' of the fabric 23' is secured to the female strip 14' as described above in connection with the preferred embodiment, and a second end 27' is secured to the male strip 12' also as described above in connection with the preferred embodiment. As a result, the first and second ends 25' and 27' are interconnected through the load-bearing fabric 20 when the prongs 18' interlock with the receptacles 24'. Alternatively, this alternative embodiment can be used to attach two separate accessories to opposite sides of the load-bearing fabric. For example, a first accessory be attached to the top of the seat while a second accessory is attached to the bottom of the seat.

Figure 9:
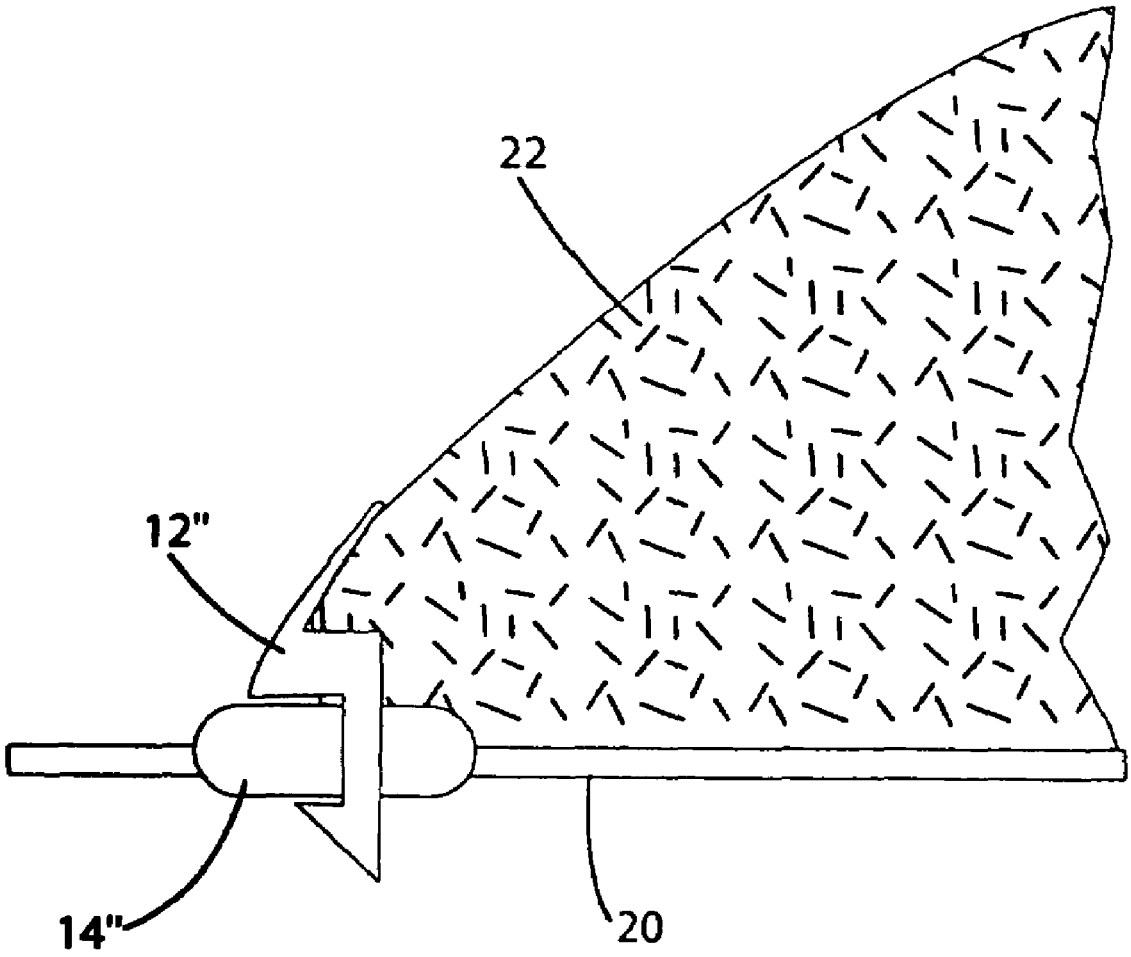
FIG. 9 is a cross sectional view of a second alternative embodiment of the present invention incorporated into a second alternative seat bolster construction.

In a second alternative embodiment, one of the two attachment strips is attached to the load-bearing fabric prior to assembly. The male or female strip may be attached to the load-bearing fabric 20 by sewing the strip directly to the fabric 20, by molding the strip in place on the fabric 20, by applying adhesive between the strip and the fabric 20 or by another conventional attachment method. For purposes of disclosure, FIG. 9 shows an embodiment in which the female strip 14" is molded in place on the load-bearing fabric 20. In this embodiment, the receptacles 24" extend vertically from one side of the fabric 20 to the other. The male strip 12" is then attached to the accessory 22, and when the prongs 18" of the male strip 12" are pressed through the female strip 14" they simultaneously pass through the fabric 20. Alternatively, the male strip can be attached to the load-bearing fabric and the female strip can be attached to the accessory 22. In applications where either the male or female strips is molded or otherwise attached to the fabric, it is not necessary for the prongs to extend through the fabric. For example, if the female strip is molded in place on the fabric, the receptacles can be entirely located on the same side of the fabric as the male strip. As a further example, if the male strip is molded in place on the fabric, the prongs will extend toward the same side of the fabric as the female strip. These alternative embodiments may prove particularly beneficial in applications where forcing the prongs through the fabric might damage the fabric.

In another alternative embodiment, the male strip and female strip can be replaced by strips that have both prongs and receptacles. In the previously described embodiments, the male strip includes the prongs exclusively and the female strip includes the receptacles exclusively. If desired, one of the two strips may include a combination of prongs and receptacles, and the other strip may include a complimentary combination of prongs and receptacles. For example, each strip may include an alternating arrangement of prongs and receptacles. This may, in some applications, permit the two strips to be essentially identical, thereby permitting their manufacture from the same tooling.

The above description is that of the preferred embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A method for attaching an item to a load-bearing fabric, comprising the steps of:

providing a first strip having at least one prong;

providing a second strip having at least one receptacle;

attaching a desired item to at least one of the first strip and the second strip;

forcing the prong of the first strip through the weave of a load-bearing fabric; and snapping the second strip onto the prong of the first strip, such that the prong is retained by the receptacle to interlock the first strip and the second strip on opposite sides of the fabric to secure the item to the fabric, wherein the prong includes a stem and a barb at the end of said stem, the barb forming a ridge and tapering to a point, wherein the receptacle includes angled fingers for snapping to the prong by flexing to receive the tapered barb of the prong and then snapping back to fit under the ridge on the prong, wherein the accessory is a seat bolster with at least one edge stitched to the first strip further comprising the step of forming spaced slits in at least one of the first strip and the second strip to provide the strip with improved flexibility.

2. The method of claim 1, wherein said attaching step includes the step of stitching the item to one of the first strip and the second strip.

3. A method for attaching an item to a load-bearing fabric, comprising the steps of:

supporting the load bearing fabric over an opening with a peripheral frame;

providing a first strip having at least one prong;

providing a second strip having at least one receptacle;

attaching a desired item to at least one of the first strip and the second strip and attaching the other of the first strip and the second strip to the fabric;

forcing the prong of the first strip through the weave of the load-bearing fabric; and snapping the second strip onto the prong of the first strip, such that the prong is retained by the receptacle to interlock the first strip and the second strip on opposite sides of the fabric to secure the item to the fabric, wherein said step of attaching one of the first strip and the second strip includes the step of molding one of the first strip and the second strip in place on the fabric, further comprising the step of forming spaced slits in at least one of the first strip and the second strip to provide the strip with improved flexibility.

4. The method of claim 3, wherein said step of molding one of the first strip and the second strip in place on the fabric includes the step of molding the second strip in place on the fabric.

5. A method for attaching an item to a load-bearing fabric having interwoven monofilaments, comprising the steps of:

supporting the load-bearing fabric over an opening with a peripheral frame;

providing a first strip having at least one prong;

providing a second strip having at least one receptacle;

attaching one of the first strip and the second strip to an item;

attaching the other of the first strip and the second strip to the load-bearing fabric; and snapping the second strip onto the prong of the first strip by forcing the prong though the interstices between adjacent interwoven strands of the fabric, such that the prong is retained by the receptacle to interlock the first strip and the second strip to secure the item to the fabric, wherein said step of attaching the other of the first strip and the second strip to the load-bearing fabric is further defined as molding the other of the first strip and the second strip in place on the load-bearing fabric, further comprising the step of forming spaced slits in at least one of the first strip and the second strip to provide the strip with improved flexibility.

* * * * *